United States Patent [19]

Lau

[11] 4,157,919

[45] Jun. 12, 1979

[54] SILVER HALIDE EMULSIONS CONTAINING YELLOW-DYE-FORMING COUPLERS

[75] Inventor: Philip T. S. Lau, Rochester, N.Y.

[73] Assignee: Eastman Kodak Company, Rochester, N.Y.

[21] Appl. No.: 892,070

[22] Filed: Mar. 31, 1978

[51] Int. Cl.[2] ..... G03C 1/40

[52] U.S. Cl. ..... 96/100 R

[58] Field of Search ..... 96/100, 74, 55, 56.6

[56] References Cited

U.S. PATENT DOCUMENTS

| | | | |
|---|---|---|---|
| 3,408,194 | 10/1968 | Loria | 96/100 |
| 3,447,928 | 6/1969 | Loria | 96/55 |
| 3,476,563 | 11/1969 | Loria | 96/100 |
| 3,542,840 | 11/1970 | Porter | 96/100 |
| 3,617,291 | 11/1971 | Sawdey | 96/100 |
| 3,894,875 | 7/1975 | Cameron et al. | 96/100 |
| 3,933,501 | 1/1976 | Cameron et al. | 96/100 |

FOREIGN PATENT DOCUMENTS

| | | | |
|---|---|---|---|
| 2408168 | 8/1974 | Fed. Rep. of Germany | 96/100 |

*Primary Examiner*—J. Travis Brown

*Attorney, Agent, or Firm*—Joshua G. Levitt

[57] ABSTRACT

Novel bis yellow-dye-forming couplers are incorporated in photographic emulsions and elements. The couplers are represented by the structural formula

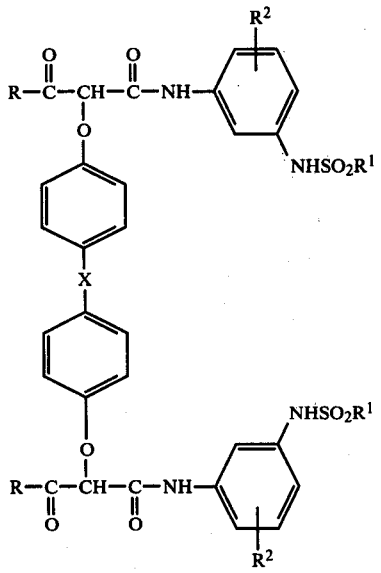

I where:

R is an aryl group of 6 to 12 carbon atoms, an aryloxyalkylene or arylthioalkylene group having 6 to 12 carbon atoms in the aryl portion of the group and 1 to 4 carbon atoms in the alkylene portion of the group, or an alkyl group of 1 to 8 carbon atoms;

$R^1$ is an alkyl group of 4 to 16 carbon atoms;

$R^2$ represents one or more halogen, lower alkyl, lower alkoxy, carboxy or lower alkoxycarbonyl substituents wherein the alkyl group and the alkyl portion of the alkoxy and alkoxycarbonyl groups contain 1 to 6 carbon atoms; and X is sulfonyl, carbonyl or alkylenedisulfonamido containing 1 to 4 carbon atoms.

10 Claims, No Drawings

SILVER HALIDE EMULSIONS CONTAINING YELLOW-DYE-FORMING COUPLERS

This invention relates to a novel class of yellow-dye-forming couplers and to photographic silver halide emulsions and elements containing such couplers. Specifically, this invention relates to a novel class of bis yellow-dye-forming couplers in which two coupler moieties are joined to one another through their coupling positions.

Color images are customarily obtained in the photographic art by reaction between the oxidation product of silver halide color developing agent (i.e. oxidized aromatic primary amino developing agent) and a color-forming compound known as a coupler. The reaction between the coupler and oxidized developing agent results in coupling of the oxidized developing agent at a reactive site on the coupler, known as the coupling position, and yields a dye. The dyes produced by coupling are indoaniline, azomethine, indamine, or indophenol dyes, depending upon the chemical composition of the coupler and of the developing agent. The subtractive process of color formation is ordinarily employed in multicolor photographic elements and the dyes produced by coupling are usually cyan, magenta and yellow dyes which are formed in or adjacent silver halide layers sensitive to radiation complementary to the radiation absorbed by the image dye; i.e., silver halide emulsions sensitive to red, green and blue radiation.

The couplers which typically are employed to produce yellow dyes are open chain ketomethylene compounds and they yield azomethine dyes upon coupling with oxidized aromatic primary amino developing agents. Typical yellow-dye-forming couplers are acylacetamides such as benzoylacetanilides and acetoacetanilides. In such couplers the coupling position, i.e., the site at which oxidized color developing agent reacts, is the active methylene group between the two carbonyl groups of the coupler. This active methylene group can be substituted or unsubstituted.

Many of the color forming couplers employed in photographic materials are four-equivalent couplers. In other words, they require four molecules of oxidized developing agent, and development of four molecules of silver halide, in order to ultimately produce one molecule of dye. Also known and used are two-equivalent couplers which require only two molecules of oxidized developing agent, and development of two molecules of silver halide, to produce one molecule of dye. Two-equivalent couplers contain a substituent in the coupling position, known as a coupling-off group, which is eliminated from the coupler following reaction with oxidized developing agent without requiring the action of two additional molecules of oxidized developing agent, as is required by four equivalent couplers.

A particular class of two-equivalent couplers are bis couplers. Such couplers contain two coupler moieties linked to one another through their respective coupling positions by a coupling off group. Bis couplers can be schematically represented as follows:

COUP
|
L
I
N
K
|
COUP where each COUP is a coupler moiety and LINK is a grouping of atoms joining the coupler moieties through their respective coupling positions. It will be appreciated that one mole of bis coupler is theoretically capable of yielding two moles of dye (one mole of dye from each coupler moiety), an amount equivalent to that obtainable from two moles of the corresponding non-bis coupler.

Bis couplers have been described from time to time in the patent art. For example, Loria U.S. Pat. No. 3,408,194 describes a class of yellow-dye-forming couplers which include bis couplers. However, bis couplers have not found practical utility in photographic materials because they are generally inferior to non-bis couplers from the standpoint of reactivity. In other words, one mole of a prior art bis coupler would yield less dye than two moles of the analogous non-bis coupler. Thus, with prior art bis couplers, to obtain an amount of dye equal to that obtainable from the corresponding non-bis coupler, more than a molar equivalent of coupler is required. This is undesirable since it requires the use of more coupler and results in thicker layers which have an adverse effect on image sharpness.

I have found a novel class of non-diffusible bis yellow-dye-forming couplers which overcome the disadvantages of prior art bis couplers. My couplers have good reactivity and relatively low molecular weight per molar equivalent of coupler, thus permitting the formation of a given amount of dye density with a minimum molecular weight per molar equivalent of coupler.

Certain of the couplers of my invention share some of the structural features of couplers described in Cameron et al U.S. Pat. No. 3,933,501. My couplers differ structurally from those of Cameron in that my couplers are bis couplers whereas Cameron's are not. This structural difference causes my couplers to have good non-diffusibility, even though they have relatively low molecular weight per molar equivalent of coupler.

In accordance with my invention, there are provided novel non-diffusible yellow-dye-forming couplers, and photographic emulsions and elements containing such couplers, the couplers being represented by the structural formula:

I

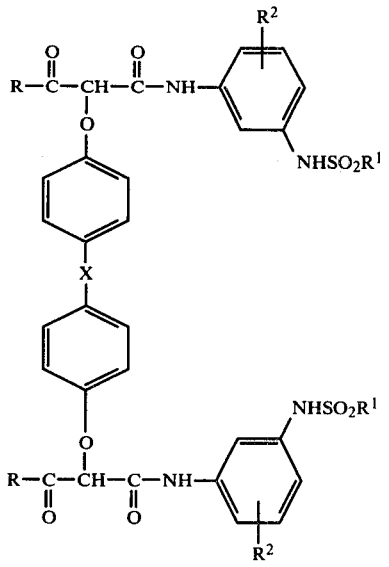

where:

R is an aryl group of 6 to 12 carbon atoms (such as phenyl, alkylphenyl, alkoxyphenyl, carboxyphenyl, alkoxycarbonylphenyl and halophenyl, the alkyl portion of the alkyl and alkoxy substituents having 1 to 6 carbon atoms); an aryloxyalkylene or arylthioalkylene group having 6 to 12 carbon atoms in the aryl portion of the group and 1 to 4 carbon atoms in the alkylene portion of the group (such as phenoxyisopropylene, phenylthioisopropylene, chlorophenoxymethylene, methoxyphenylthioethylene, cyanophenylthioisobutylene and ethylphenoxyisopropylene); or an alkyl group of 1 to 8 carbon atoms (such as methyl, ethyl, propyl, pentyl, hexyl, and octyl); preferably R is a t-alkyl group of 4 to 8 carbon atoms (such as t-butyl, t-pentyl, and t-octyl) and most preferably R is a t-butyl group;

$R^1$ is a straight or branched chain alkyl group of 4 to 16 carbon atoms (such as butyl, octyl, hexyl, nonyl, decyl, dodecyl, pentadecyl, and hexadecyl); preferably $R^1$ is an alkyl group of 8 to 12 carbon atoms;

$R^2$ represents one or more halogen (e.g. chloro, bromo, fluoro), lower alkyl, lower alkoxy, carboxy or lower alkoxycarbonyl substituents wherein the alkyl group and the alkyl portion of the alkoxy and alkoxycarbonyl groups contains 1 to 6 carbon atoms; preferably $R^2$ is a halogen substituent and most preferably $R^2$ is a 1-chloro substituent; and X is sulfonyl ($-\overset{O}{\underset{O}{S}}-$), carbonyl ($-\overset{O}{C}-$)

or alkylenedisulfonamido containing 1 to 4 carbon atoms ($-NHSO_2(CH_2)_nSO_2NH-$, $n=1$ to 4).

Preferred couplers of this invention can be represented by the structural formula:

II

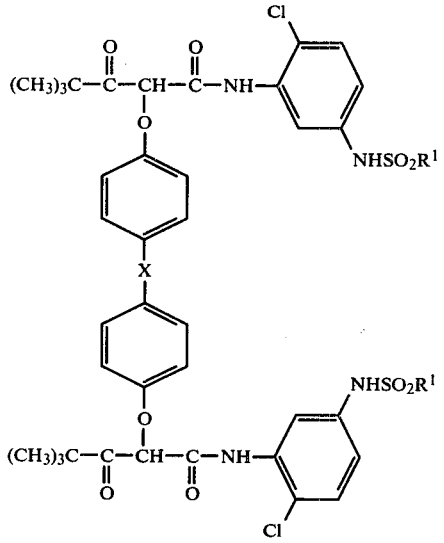

where:

$R^1$ is alkyl of 4 to 16 carbon atoms and X is sulfonyl, carbonyl or methylenedisulfonamido.

Especially preferred couplers of this invention can be represented by the structural formula:

III

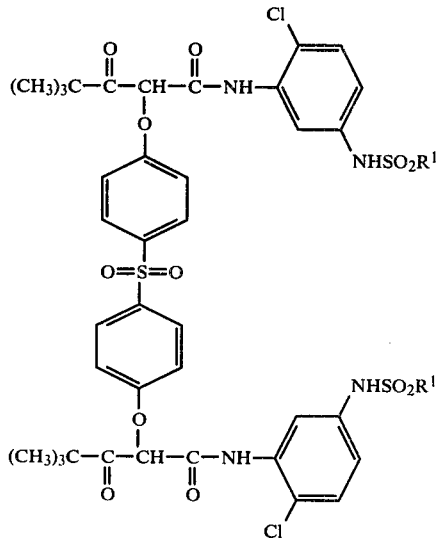

where:

$R^1$ is alkyl of 8 to 12 carbon atoms.

Couplers of this invention preferably have a molecular weight of between about 1000 and 1500. Most preferably, they have a molecular weight of between 1100 and 1300.

Couplers within the scope of this invention are exemplified in Table I below with reference to Formula I, above.

TABLE I

| Coupler No. | X | R | $R^1$ | $R^2$ | Molecular Weight |
|---|---|---|---|---|---|
| I | $-\overset{\overset{O}{\|}}{\underset{\underset{O}{\|}}{S}}-$ | $(CH_3)_3C-$ | $-C_{16}H_{33}$-n | 1-Cl | 1370 |
| II | $-\overset{\overset{O}{\|}}{\underset{\underset{O}{\|}}{S}}-$ | $(CH_3)_3C-$ | $-C_8H_{17}$-n | 1-Cl | 1136 |
| III | $-\overset{\overset{O}{\|}}{C}-$ | $(CH_3)_3C-$ | $-C_8H_{17}$-n | 1-Cl | 1100 |
| IV | $-\overset{\overset{O}{\|}}{C}-$ | $(CH_3)_3C-$ | $-C_{16}H_{33}$-n | 1-Cl | 1324 |
| V | $-\overset{\overset{O}{\|}}{\underset{\underset{O}{\|}}{S}}-$ | $(CH_3)_3C-$ | $-C_{10}H_{21}$-n | 1-Cl | 1192 |
| VI | $-\overset{\overset{O}{\|}}{\underset{\underset{O}{\|}}{S}}-$ | $(CH_3)_3C-$ | $-C_{12}H_{25}$-n | 1-Cl | 1248 |
| VII | $-\overset{\overset{O}{\|}}{\underset{\underset{O}{\|}}{S}}-$ | $(CH_3)_3C-$ | $-C_4H_9$-n | 1-Cl | 1024 |
| VIII | $-NHSO_2CH_2SO_2NH-$ | $(CH_3)_3C-$ | $-C_{16}H_{33}$-n | 1-Cl | 1468 |

Couplers of my invention can be prepared by condensing an appropriate derivative of the non-bis coupler with an appropriate derivative of the linking group. For example, two moles of a coupler containing a chlorine atom in the coupling position can be reacted with one mole of a dihydroxy substituted linking group in the presence of an acid acceptor to yield one mole of the bis coupler. Preparation of specific couplers within the scope of the present invention is illustrated in Example 1 of this application.

The couplers of this invention can advantageously be incorporated in photographic silver halide emulsions by a variety of known techniques. Preferred techniques are described, for instance, in Mannes et al U.S. Pat. Nos. 2,304,939 and 2,304,940 and Jelley et al U.S. Pat. No. 2,322,027, in which the coupler is first dissolved or dispersed in a high boiling organic solvent and then blended with the silver halide emulsion; and in Vittum et al U.S. Pat. No. 2,801,170, Fierke et al U.S. Pat. No. 2,801,171 and Julian U.S. Pat. No. 2,479,360, in which low boiling or water-miscible organic solvents are used in conjunction with or in place of a high boiling organic solvent to dissolve or disperse the coupler.

The silver halide emulsion, containing the coupler, can be used as the sole layer in a photographic element. Alternatively and preferably, the silver halide emulsion can be used to form one of the layers in a multilayer, multicolor photographic element. When incorporated in such elements, useful concentrations of the coupler generally will be in the range of about 0.15 to 2.0 grams of coupler per square meter of coating.

Multicolor multilayer photographic elements are known with a variety of layers and a variety of configurations and the couplers of this invention can be incorporated in any of the locations where yellow couplers have been employed. A typical element in which the couplers and emulsions of this invention can be incorporated would have the following main components:

(A) A support, such as cellulose nitrate film, cellulose acetate film, polyvinylacetal film, polystyrene film, poly(ethylene terephthalate) film, polyethylene film, polypropylene film and related films of resinous materials as well as paper, polyethylene-coated paper, glass and other known support mateials.

(B) An antihalation layer such as described, for instance, in Glafkides "Photographic Chemistry" Volume 1, pages 470–471, Arrowsmith Ltd., 1958.

(C) A plurality of light-sensitive coupler-containing silver halide emulsion layers on the support, optionally with one or more gelatin layers between. Preferably, the element contains red-sensitive, green-sensitive and blus-sensitive silver halide emulsion layers. The support bears, in succession, a red-sensitive layer containing one or more cyan-dye-forming couplers, a green-sensitive layer containing one or more magenta-dye-forming couplers and a blue-sensitive layer, containing one or more yellow-dye-forming couplers, including at least one of the yellow-dye-forming couplers of this invention. Typically the element contains a yellow filter layer (e.g. Carey-Lea silver) between the blue- and green-sensitive layers. Alternatively, the dye-forming couplers can be contained in layers adjacent the light-sensitive layers with which they are associated. The light-sensitive layers can also be arranged in any other order that is desired, with the exception that if a yellow filter layer is employed it would not be desirable to place it over a blue-sensitive layer. The light-sensitive layers can be divided into sublayers having the same or different sensitometric and/or physical properties, such as photographic speed, size, distribution of components, etc., and these sublayers can be arranged in varying relationships.

The light-sensitive silver halide emulsions can include coarse, regular, or fine grain silver halide crystals or mixtures thereof and can be comprised of such silver halides as silver chloride, silver bromide, silver bromoiodide, silver chlorobromide, silver chloroiodide, silver chlorobromoiodide and mixtures thereof. Suitable such emulsions are described, for instance, in "The Photographic Journal", Volume LXXIX, May 1939, pages 330–338; "Journal of Photographic Science," Volume 12, No. 5, Sept./Oct. 1964, pages 242–251, and also in U.S. Pat. Nos. 2,184,013; 2,456,953; 2,541,472; 2,563,785, 3,367,778, 3,501,307, 3,582,322 and 3,622,318. Such silver halide emulsions typically are gelatin emulsions although other hydrophilic colloids can be used in accordance with usual practice.

(D) One or more gelatin or hydrophilic colloid spacer layers between the light-sensitive emulsion layers and between the emulsion layers and the yellow filter layer as above described. The spacer layers preferably contain compounds which prevent the interlayer migration of development products which are not desired in adjacent layers, such as oxidized developing agents. Suitable compounds for this purpose are scavengers described in, e.g. U.S. Pat. Nos. 2,360,290; 2,403,721 and 2,701,197; and British Pat. No. 700,453.

(E) A protective water-permeable overcoat layer, such as gelatin or another hydrophilic colloid. The overcoat can conveniently contain an aldehyde scavenger such as described for instance, in U.S. Pat. Nos. 3,236,652; 3,287,135; 3,220,839; 2,403,927; and British Pat. No. 623,448. The overcoat can also contain other ingredients such as buffering agents (e.g., an acidic or basic material), and ultraviolet light absorbers.

This invention is further described by the following examples.

EXAMPLE 1

Preparation of Couplers I and IV

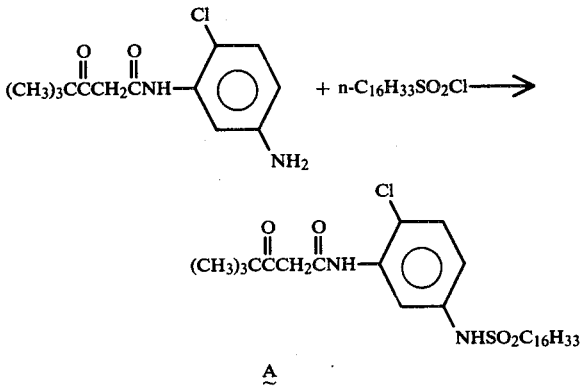

A

To a stirred solution of 134.4 grams (0.5 mole) of α-pivolyl-2-chloro-5-amino acetanilide in 300 ml pyridine was added at room temperature 162.5 grams (0.5 mole) of n-hexadecane sulfonyl chloride. After stirring for 1 hour the reaction mixture was poured into 1 liter of ice-water. The solid was collected, washed with water and then with cold methanol. Recrystallization from ligroine gave 251 grams (90%) of white crystalline solid (A), m.p. 100°–101° C.

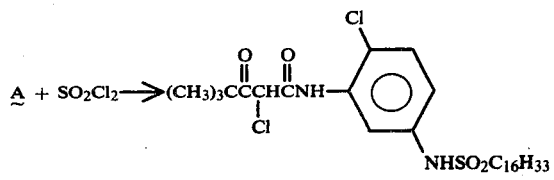

B

To a solution of 251 grams (0.45 mole) of A in 700 ml chloroform was added dropwise at room temperature 67.5 grams (0.5 mole) of sulfuryl chloride. The reaction mixture was stirred at room temperature for 1.0 hour after which the solvent was removed under reduced pressure to give an oil. The residual oil was dissolved in methanol and allowed to stand overnight in the refrigerator. The crystalline solid was collected to give 240 grams of product B, m.p. 48°–49° C.

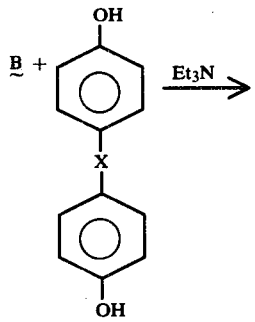

$X = SO_2, -\overset{O}{\overset{\|}{C}}-$

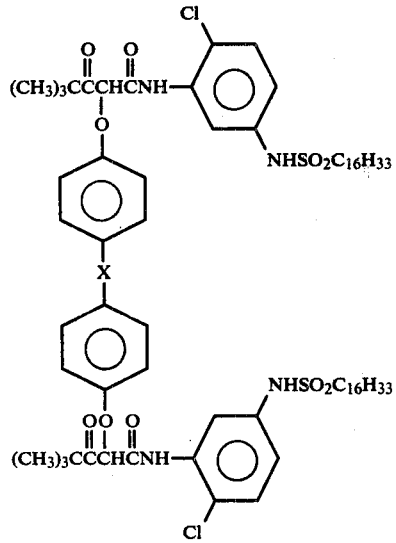

Coupler I or IV

To a solution of 11.8 grams (0.02 mole) of B and 2.2 grams triethylamine (0.22 mole) in 200 ml acetonitrile, was added with stirring a solution of 0.01 mole 4,4'-sulfonyldiphenol ($X=SO_2$), or 0.01 mole 4,4'-dihydroxybenzophenone $$(X{=}\overset{\overset{\displaystyle O}{\|}}{C}),$$

in 50 ml acetonitrile. The reaction mixture was heated on a steam bath for 3 hours. After cooling the mixture was poured into 500 ml ice-water plus 15 ml concentrated hydrochloric acid. The resinous solid was collected, washed with water and dried. The crude product was dissolved in a minimum amount of benzene and passed through a silica gel column using a solvent mixture of 10 parts benzene to 1 part of ethyl acetate as eluant. The bis-coupler thus obtained could be further recrystallized from acetonitrile or from an ethyl acetate-hexane solvent mixture. Other couplers of this invention can be made using an equivalent amount of a 4,4'-alkylenesulfonamidodiphenol in place of 4,4'-sulfonyldiphenol. Thus, coupler VIII could be prepared using 0.01 mole of 4,4'-methylenesulfonamidodiphenol in the above reaction in place of 4,4'-sulfonyldiphenol.

EXAMPLE 2

Preparation And Evaluation Of Photographic Elements

Single-layer silver halide emulsion coatings were prepared containing 0.76 g/m$^2$ silver, 3.78 g/m$^2$ gelatin, and molar equivalents of couplers I through VI of this invention (see Table I supra) and control couplers 1 and 2. Coupler 1 is shown in Table 1 of U.S. Pat. No. 3,933,501 as coupler A and has the structure:

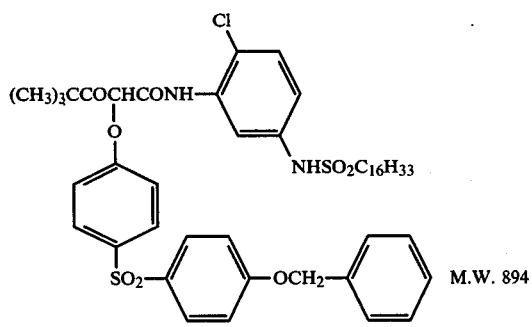

Coupler 2 is shown in U.S. Pat. No. 3,408,194 as coupler 36 and has the structure:

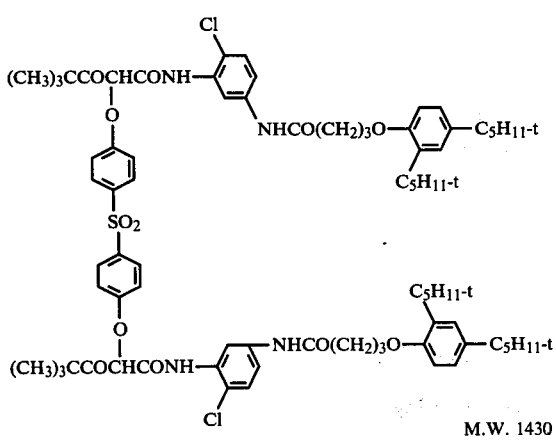

The amount of each coupler in the emulsion layer was as follows:

| Coupler | No. of Coupling Sites | Moles/m$^2$ | g/m$^2$ |
|---|---|---|---|
| 1 | 1 | 2.68 | 2.40 |
| 2 | 2 | 1.34 | 1.87 |
| I | 2 | 1.34 | 1.83 |
| II | 2 | 1.34 | 1.52 |
| III | 2 | 1.34 | 1.45 |
| IV | 2 | 1.34 | 1.78 |
| V | 2 | 1.34 | 1.60 |
| VI | 2 | 1.34 | 1.68 |
| VII | 2 | 1.34 | 1.38 |
| VIII | 2 | 1.34 | 1.98 |

Portions of the elements were sensitometrically exposed through a graduated-density test object and conventionally processed as follows at 40° C.

| Processing Step And Composition | Time (min.) |
|---|---|
| Color Developer No. 1 or No. 2 (see infra) | 2 |
| Stop | 2 |
| 30 ml glacial acetic acid | |
| Water to 1 liter, pH to 3.0 | |
| Wash | 2 |
| Bleach | 2 |
| 21.5 g NaBr | |
| 100.0 g $K_3Fe(CN)_6$ | |
| 0.07 g $NaH_2PO_4 \cdot H_2O$ | |
| Water to 1 liter, pH to 7.0 | |
| Wash | 2 |
| Fix | 2 |
| 250.0 g $Na_2S_2O_3 \cdot 10H_2O$ | |
| 1.5 g $NaHSO_3$ | |
| 6.0 g $Na_2SO_3$ | |
| Water to 1 liter, pH to 7.0 | |
| Wash | 2 |
| Dry (No heat) | |

The developer solutions had the following compositions:

| Developer No. 1 | Developer No. 2 |
|---|---|
| 2.0 g $K_2SO_3$ | 2.0 g $K_2SO_3$ |
| 2.45 g 4-Amino-3-methyl-N,N-diethylaniline hydrochloride | 5.0 g 4-Amino-3-methyl-N-ethyl-N-β-(methanesulfonamido) ethylaniline sulfate hydrate |
| 30.0 g $K_2CO_3$(anhydrous) | 30.0 g $K_2CO_3$(anhydrous) |
| 1.25 g KBr | 1.25 g KBr |
| 0.0006 g KI | 0.0006 g KI |
| Water to 1 liter, pH to 10.0 | Water to 1 liter, pH to 10.0 |

The processed samples were evaluated by recording their photographic activity, i.e. $D_{max}$, fog, gamma and speed. The results are recorded in Table II below.

TABLE II

| Coupler | Developer | $D_{max}$ | Fog | Gamma | Speed |
|---|---|---|---|---|---|
| 1 | No. 2 | 3.03 | 0.14 | 0.84 | 3.66 |
| 2 | No. 2 | 1.93 | 0.09 | 0.76 | 3.41 |
| 1 | No. 1 | 3.44 | 0.19 | 1.16 | 3.52 |
| | No. 2 | 2.81 | 0.15 | 0.84 | 3.60 |
| I | No. 1 | 3.71 | 0.20 | 1.33 | 3.51 |
| | No. 2 | 3.01 | 0.14 | 0.87 | 3.56 |
| 1 | No. 1 | 3.54 | 0.26 | 1.33 | 3.66 |
| | No. 2 | 2.51 | 0.09 | 0.77 | 3.44 |
| II | No. 1 | 3.67 | 0.23 | 1.35 | 3.56 |
| | No. 2 | 2.49 | 0.08 | 0.78 | 3.28 |
| 1 | No. 1 | 3.58 | 0.19 | 1.18 | 3.53 |
| | No. 2 | 3.03 | 0.14 | 0.84 | 3.66 |
| III | No. 1 | 3.68 | 0.18 | 1.64 | 3.39 |
| | No. 2 | 2.52 | 0.10 | 0.80 | 3.35 |
| 1 | No. 1 | 3.58 | 0.19 | 1.18 | 3.53 |
| | No. 2 | 3.03 | 0.14 | 0.84 | 3.66 |

TABLE II-continued

| Coupler | Developer | $D_{max}$ | Fog | Gamma | Speed |
|---|---|---|---|---|---|
| IV | No. 1 | 3.70 | 0.17 | 1.36 | 3.68 |
| | No. 2 | 2.51 | 0.13 | 0.70 | 3.68 |
| 1 | No. 1 | 3.88 | 0.19 | 1.78 | 3.86 |
| | No. 2 | 3.11 | 0.13 | 0.83 | 3.95 |
| V | No. 1 | 3.94 | 0.16 | 1.76 | 3.92 |
| | No. 2 | 2.95 | 0.11 | 0.77 | 3.99 |
| 1 | No. 1 | 3.88 | 0.19 | 1.78 | 3.86 |
| | No. 2 | 3.11 | 0.13 | 0.83 | 3.95 |
| VI | No. 1 | 3.88 | 0.18 | 1.72 | 3.82 |
| | No. 2 | 3.10 | 0.12 | 0.84 | 3.94 |
| 1 | No. 1 | 3.76 | 0.11 | 1.58 | 3.48 |
| | No. 2 | 3.37 | 0.11 | 1.08 | 3.63 |
| VII | No. 1 | 2.81 | 0.10 | 1.54 | 3.57 |
| | No. 2 | 2.72 | 0.12 | 0.97 | 3.80 |
| 1 | No. 1 | 3.63 | 0.12 | 1.23 | 3.48 |
| | No. 2 | 3.23 | 0.10 | 0.95 | 3.77 |
| VIII | No. 1 | 3.69 | 0.13 | 1.49 | 3.54 |
| | No. 2 | 2.86 | 0.11 | 1.00 | 3.76 |

This data indicates that prior art bis coupler 2 yields significantly less dye density than control coupler 1. With the exception of coupler VII, all of the couplers of this invention yield essentially the same dye density as control coupler 1 with no significant differences in fog, gamma or photographic speed, while having a lower molecular weight per molar equivalent of coupler than prior art bis coupler 2. Coupler VII crystallized somewhat in the particular dispersion employed in the coating and, hence, yielded less dye density than control coupler 1. Nevertheless, it yielded significantly more dye density than prior art bis coupler 2.

This invention has been described in detail with particular reference to certain preferred embodiments thereof, but it will be understood that variations and modifications can be effected within the spirit and scope of the invention.

What is claimed is:

1. A photographic element comprising a support bearing at least one layer of a photosensitive silver halide emulsion and a non-diffusible, yellow-dye-forming coupler having the structural formula:

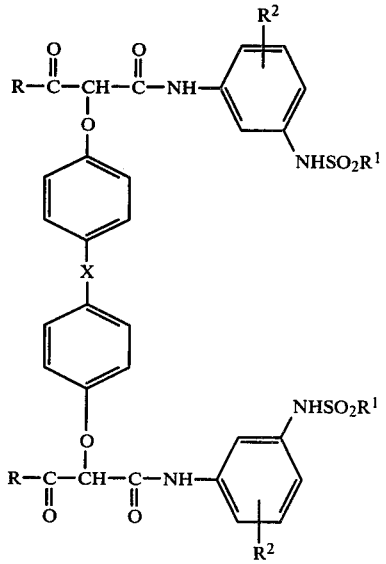

where:

R is an aryl group of 6 to 12 carbon atoms, an aryloxyalkylene or arylthioalkylene group having 6 to 12 carbon atoms in the aryl portion of the group and 1 to 4 carbon atoms in the alkylene portion of the group, or an alkyl group of 1 to 8 carbon atoms;

$R^1$ is an alkyl group of 4 to 16 carbon atoms;

$R^2$ represents one or more halogen, lower alkyl, lower alkoxy, carboxy or lower alkoxycarbonyl substituents wherein the alkyl group and the alkyl portion of the alkoxy and alkoxycarbonyl groups contains 1 to 6 carbon atoms; and X is sulfonyl, carbonyl or alkylenedisulfonamido containing 1 to 4 carbon atoms.

2. A photograhic element of claim 1 wherein R is a t-alkyl group of 4 to 8 carbon atoms.

3. A photographic element of claim 2 wherein $R^2$ is halogen.

4. A photographic element of claim 1 wherein the non-diffusible yellow-dye-forming coupler has the structural formula:

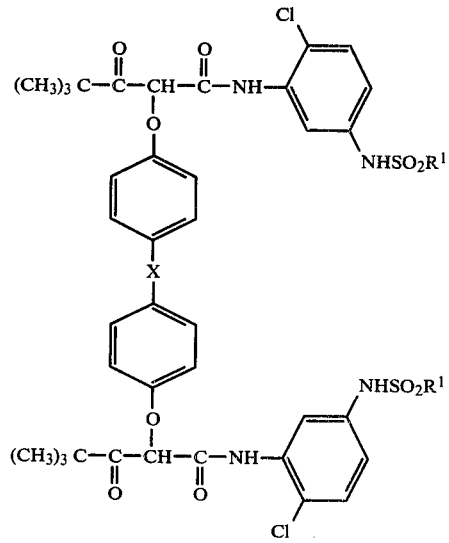

where $R^1$ is alkyl of 4 to 16 carbon atoms and X is sulfonyl, carbonyl or methylenedisulfonamido.

5. A photographic element comprising a support bearing at least one layer of a silver halide emulsion containing a non-diffusible yellow-dye-forming coupler having the structural formula:

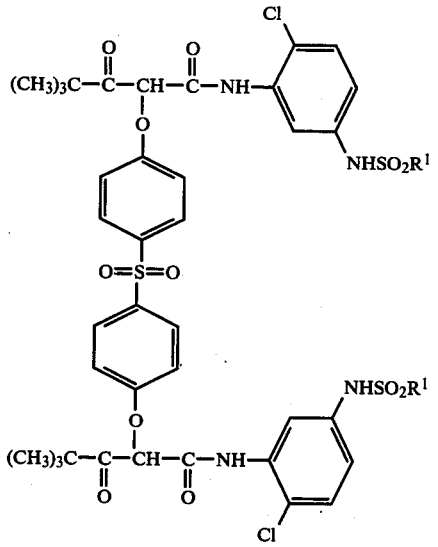

where $R^1$ is alkyl of 8 to 12 carbon atoms.

6. A photographic silver halide emulsion containing a non-diffusible yellow-dye-forming coupler having the structural formula:

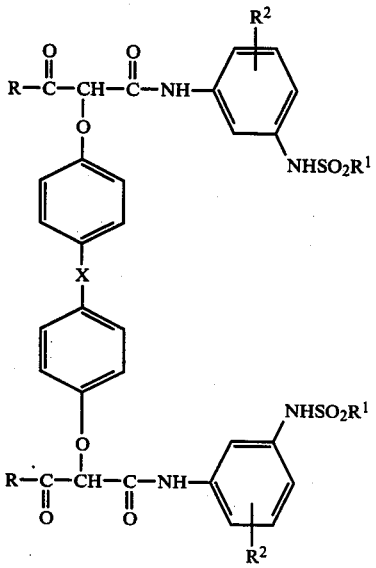

where:

R is an aryl group of 6 to 12 carbon atoms, an aryloxyalkylene or arylthioalkylene group having 6 to 12 carbon atoms in the aryl portion of the group and 1 to 4 carbon atoms in the alkylene portion of the group, or an alkyl group of 1 to 8 carbon atoms;

$R^1$ is an alkyl group of 4 to 16 carbon atoms;

$R^2$ represents one or more halogen, lower alkyl, lower alkoxy, carboxy or lower alkoxycarbonyl substituents wherein the alkyl group and the alkyl portion of the alkoxy and alkoxycarbonyl groups contains 1 to 6 carbon atoms; and X is sulfonyl, carbonyl or alkylenedisulfonamido containing 1 to 4 carbon atoms.

7. A photographic silver halide emulsion of claim 6 wherein R is a t-alkyl group of 4 to 8 carbon atoms.

8. A photographic silver halide emulsion of claim 7 wherein $R^2$ is halogen.

9. A photographic silver halide emulsion of claim 6 wherein the non-diffusible yellow-dye-forming coupler has the structural formula:

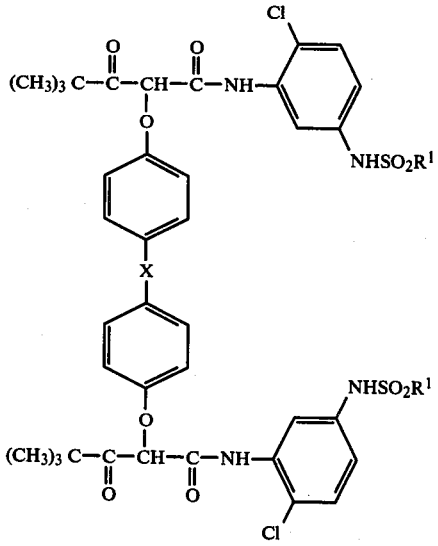

where $R^1$ is alkyl of 4 to 16 carbon atoms and X is sulfonyl, carbonyl or methylenedisulfonamido.

10. A photographic silver halide emulsion containing a non-diffusible yellow-dye-forming coupler having the structural formula:

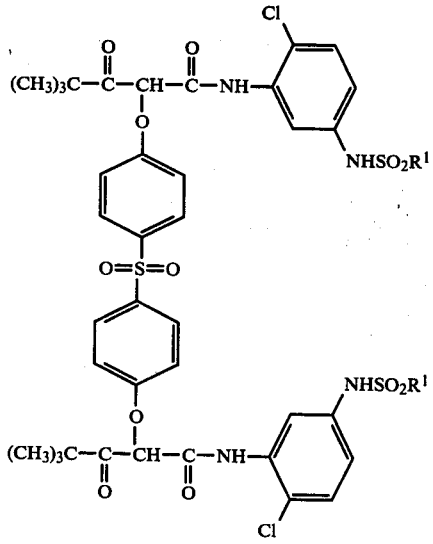

where $R^1$ is alkyl of 8 to 12 carbon atoms.

* * * * *